United States Patent [19]

Heller et al.

[11] Patent Number: 4,645,511

[45] Date of Patent: Feb. 24, 1987

[54] AFTERTREATMENT OF DYED OR PRINTED TEXTILES WITH A POLYMERIC POLYBASIC AMINO COMPOUND

[75] Inventors: Jürg Heller, Oberwil; Bruno Kissling, Hagendorf; Tibor Robinson, Basel; Salvatore Valenti, Binningen, all of Switzerland

[73] Assignee: Sandoz Ltd., Basel, Switzerland

[21] Appl. No.: 686,135

[22] Filed: Dec. 24, 1984

[30] Foreign Application Priority Data

Jan. 3, 1984 [DE] Fed. Rep. of Germany ..... 3400051

[51] Int. Cl.[4] ..... C09B 62/00

[52] U.S. Cl. ..... 8/549; 8/606; 8/496; 8/566; 8/917; 8/918; 8/924; 8/681; 8/551

[58] Field of Search ..... 8/496, 556, 549, 565, 8/566, 570, 573, 551; 528/250, 263, 268

[56] References Cited

U.S. PATENT DOCUMENTS

| | | | |
|---|---|---|---|
| 2,649,354 | 8/1953 | Hemmi et al. | 8/551 |
| 3,873,266 | 3/1975 | Hofer et al. | 8/551 |
| 4,410,652 | 10/1983 | Robinson et al. | 8/551 |
| 4,439,203 | 3/1984 | Runyon et al | 8/556 |

FOREIGN PATENT DOCUMENTS

| | | |
|---|---|---|
| 877948 | 9/1961 | United Kingdom . |
| 1114036 | 5/1968 | United Kingdom . |
| 2006279 | 5/1979 | United Kingdom . |
| 2106126 | 4/1983 | United Kingdom . |
| 2111538 | 7/1983 | United Kingdom . |
| 2122634 | 1/1984 | United Kingdom . |

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

Aftertreatment of textile fibres which have been optically brightened or dyed or printed with certain direct dyes, or with basic or sulphur dyes, increases wet-fastness properties. The aftertreatment agent is a polymeric, polybasic amino compound, which is applied under alkaline conditions.

31 Claims, No Drawings

AFTERTREATMENT OF DYED OR PRINTED TEXTILES WITH A POLYMERIC POLYBASIC AMINO COMPOUND

This invention relates to the aftertreatment of dyed, printed or brightened textile fibres.

The present invention provides a process for the dyeing, printing or brightening of hydroxy group- or nitrogen-containing textile fibres comprising the steps of (a) dyeing or printing the fibres with one or more direct dyestuffs containing in their molecules at least one 5- or 6-membered heterocyclic aromatic ring substituted by 1 to 3 halogen atoms, or with a sulphur dyestuff, or with a basic dyestuff, or brightening the fibres with an optical brightener, and subsequently (b) treating the dyed, printed or brightened substrate with a polymeric, polybasic amino compound (A) at a pH of from 7 to 14.

Preferred substrates are cellulosic substrates, particularly cotton and regenerated cellulose, especially cotton. The fibres may be in the form of loose fibres or yarns or fabrics, or in any suitable form. Fabrics are a convenient and preferred form. The fibres may be blended with other fibres which are susceptible of treatment by the process of the invention or with fibres which are not so susceptible. For example, cotton and regenerated cellulose fibres may be blended together or individually with polyester fibres, the latter being dyed with disperse dyes. Fibre blends and yarn blends may be used.

The dyeing, printing or brightening of the substrate may be carried out by conventional methods suitable for the dye or brightener to be used.

Preferred dyes are a group of dyes having the properties both of direct dyes and of reactive dyes. That is, they are highly substantive to cotton when dyed by the conventional exhaust process, giving a degree of exhaustion of 70–100%, preferably 80–100% when dyed at the boil at 1/1 standard depth. Furthermore, they contain in their molecular one or more halogen atoms attached to aromatic heterocyclic rings, which can be split off as an anion under alkaline fixation conditions.

Preferred dyestuffs of this type contain at least two sulphonic acid or sulphonamide groups in the dye molecule, more preferably 3 to 8 such groups, particularly 4 to 6. Preferably the dyes have a molecular weight above 1000, more preferably above 1200, and are preferably in the form of 1:1 or 1:2 metal complexes, particularly copper complexes. Preferred dyestuffs contain one or two mono- or di-halo (particularly chloro-) substituted triazinyl groups.

Examples of dyestuffs with one such group correspond to formula I

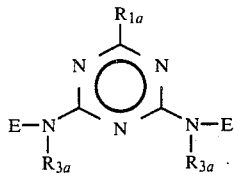

I in which each $R_{3a}$ independently is hydrogen; $(C_{1-4})$alkyl; or $(C_{1-4})$alkyl substituted by one —OH, —CN or phenyl group;

$R_{1a}$ is Cl or F, particularly Cl and the E's are identical or different chromophoric groups.

Examples of dyestuffs with two triazinyl groups are those of formula II

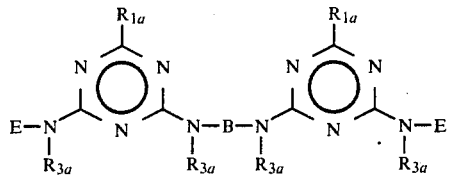

II in which $R_{1a}$, $R_{3a}$ and are as defined above, and B is a direct bond or a divalent aliphatic, aromatic, cycloaliphatic or heterocyclic bridging group, or forms a heterocyclic bridging group together with the two

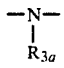

groups to which it is joined.

In the compounds of formulae I and II, the chromophoric groups E can be identical or different residues of mono- or polyazo dyes, or of anthraquinone, stilbene, hydrazone, methine or azomethine dyes, in which the mono- or polyazo dye residues may be in the form of 1:1 or 1:2 metal complexes, such as 1:1 copper, chromium, cobalt, nickel or manganese or 1:2 chromium, cobalt or iron complexes.

The bridging group B is preferably of formula

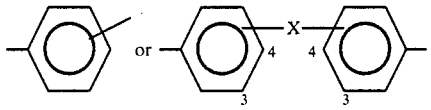

in which X can be bound in the 4,4-, 3,4- or 3,3-positions and represents a direct bond or a bridging group such as is conventional in the chemistry of direct dyestuffs, or may form a piperazine ring together with the two

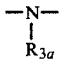

groups to which it is bound.

Suitable triazinyl group-containing dyestuffs are disclosed in British published patent applications Nos. 2,106,126 A, 2,111,538 A, and 2,122,634 A.

Basic dyestuffs suitable for use in the process according to the invention are generally those designated as C.I. Basic Dyes. They contain protonatable primary, secondary or tertiary amino groups and/or quaternary ammonium groups, and may also contain sulphonic acid groups, provided that the number of basic groups is higher than the number of acid groups in the molecule. Basic dyes may also be in the form of 1:1 or 1:2 metal complexes. Suitable basic dyes are described for example in U.S. Pat. No. 4,439,208.

In addition to the above-mentined direct and basic dyes, it is also possible to dye or print the textile fibres with sulphur dyestuffs.

Optical brighteners may also be used, preferably anionic optical brighteners which are substantive to cotton.

The polymeric polybasic amino compound (A) is preferably (A1) the reaction product of an amine of formula III $$R—NH—R \qquad III$$

or, more preferably, a polyalkylene polyamine of formula IV $$RRN—Z—(X—Z)_n—NRR \qquad IV$$

in which each

R independently is hydrogen or a $C_{1-10}$alkyl group unsubstituted or monosubstituted with hydroxy, $C_{1-4}$alkoxy or cyano, n is a number from 0 to 100

Z, or each Z independently when n>0, is $C_{2-4}$alkylene or hydroxyalkylene and X, or each X independently when n>1, is —O—, —S— or —NR— where R is as defined above, provided that the amine of formula IV contains at least one reactive —NH— or —$NH_2$ group, with cyanamide, dicyandiamide (DCDA), guanidine or bisguanidine.

More preferably in formula IV each R is hydrogen, n is 0 to 4, X is —NH— or —$NCH_3$— and Z, or each Z independently when n>0, is $C_{2-4}$alkylene. Particularly preferred compounds are diethylene triamine, triethylene tetramine, tetraethylene pentamine, 2-aminoethyl-3-aminopropylamine, dipropylene triamine and N,N-bis-(3-aminopropyl)methylamine.

Compounds (A1) are known, and may be prepared by the methods described for example in British Pat. No. 657 753, U.S. Pat. No. 2,649,354 and U.S. Pat. No. 4,410,652. Suitably the amine, in free base or salt form, is reacted with the other starting material in the absence of water at elevated temperatures optionally in the presence of a non-aqueous solvent. Preferably the reaction is carried out in the absence of solvent at a temperature of 140°-160° C., and for most combinations of reagents, ammonia is evolved. The reagents are preferably reacted in a molar ratio of 0.1 to 1 mole of cyanamide, DCDA, guanidine or biguanidine per mole of reactive —NH— or —$NH_2$ groups, and when DCDA is reacted with a polyalkylene polyamine, the molar ratio of the reactants is more preferably from 2:1 to 1:2, particularly about 1:1.

The products (A1) are near-colourless viscous liquids or solids which are basic in character, water-soluble either in the free base or salt form, and contain reactive hydrogen atoms bonded to nitrogen.

Up to 50% mole, preferably up to 20% mole of the DCDA or other reagent to be reacted with the amine may be replaced by a dicarboxylic acid or a mono- or di-ester thereof. Suitable acids include adipic acid, oxalic acid and terephthalic acid, for example in the form of their dimethyl esters.

Particularly preferred compounds (A1) are the reaction products of DCDA with diethylenetriamine or triethylenetetramine.

A further group of preferred compounds (A) are compounds (A2) which are the reaction products of compounds (A1) with epihalohydrins or precursors thereof, particularly with epichlorohydrin. Such products are described in U.S. Pat. No. 4,439,203, the disclosure of which is incorporated herein by reference. The reaction product of (A1) with epichlorohydrin may also be obtained in the form of a stable aqueous dispersion by acidifying the reaction product obtained as described in U.S. Pat. No. 4,439,203, optionally in the presence of a water-soluble polymer, to a pH of 2-5, preferably 4-4.5.

A further group of preferred polymeric polybasic amino compounds (A) are the compounds (A3), which are the reaction products of compounds (A1) with an organic compound (B) containing at least two groups capable of being split off as anions on reaction with (A1).

Preferred compounds (B) are of formula V, VI or VII $$HN(CH_2CH_2Cl)_2 \qquad V$$

$$BrCH_2CH_2Br \qquad VI$$

VII

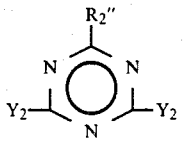

in which both $Y_2$'s are identical and are Cl or Br $R_2''$ is Cl or —NH—$C_3H_6$—$N^{\oplus}(CH_3)_3$ $A^{\ominus}$ where $A^{\ominus}$ is $Cl^{\ominus}$ or $CH_3SO_4^{\ominus}$.

Compound V is preferably in acid addition salt form e.g. $H_2N^{\oplus}(CH_2CH_2Cl)_2$ $Cl^{\ominus}$.

The reaction with polymeric compound (A1) is preferably carried out in water or an organic solvent at a temperature of from −5° to 130° C., preferably 20°-70° C., and under neutral to mildly alkaline conditions.

Suitably from 0.1 to 3 molar equivalents (i.e. from 0.05 to 1.5 moles) of compound (B) for each equivalent of the polymeric compound (A1), based on the number of functional groups in the original amine. More preferably from 0.2 to 0.5 molar equivalents of (B) are used for each equivalent of (A1).

The compounds of formula (B) are known or can be prepared in conventional manner from available starting materials.

A further preferred group of polymeric polybasic amino compounds (A) are the compounds (A4), which are the reaction products of epihalohydrins or precursors thereof with polyalkylene polyamines (C). Preferred compounds (A4) are the reaction products of 1.5-2.5 moles of epichlorohydrin with 1 mole of a polyalkylene polyamine (C) of formula VIII

VIII

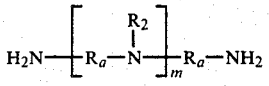

in which m is a number from 1 to 5;

each $R_a$ independently, is a $C_{2-4}$alkylene group and each $R_2$ independently is phenyl, $C_{1-4}$alkyl or $C_{1-4}$alkyl substituted by a —OH, $C_{1-4}$alkoxy, halogen or phenyl group.

Particularly preferred compounds (A4) are the reaction products of 1.8-2.3 mole epichlorohydrin with 1 mole of N,N-bis-(3-aminopropyl)methylamine.

The reaction between epichlorohydrin and compounds (C) may be carried out in water or an organic solvent at temperatures from −5° to 100° C., preferably between 20° and 70° C.

The aftertreatment with compound (A) is preferably carried out at a pH from 8 to 12, more preferably from 10 to 11. It may be a continuous process, for example, padding, dipping, spraying or foam finishing, but is preferably a batchwise exhaust process. It may be carried out at temperatures from 20°–190° C., preferably at 30°–70° for 3 to 60 minutes, preferably 5 to 20 minutes, preferably in the presence of 5 to 10 g/l of an electrolyte e.g. sodium chloride or sodium sulphate. The quantity of compound (A) used will depend upon the depth of dyeing of the substrate, but from 0.1 to 6%, preferably 1 to 2%, based on the dry weight of substrate may be suitable. The pH range of the aftertreatment bath may be adjusted by addition of an alkali metal carbonate or hydroxide, preferably sodium or potassium carbonate or hydroxide. The liquor to goods ratio of the aftertreatment bath may be from 2:1 to 50:1, and the dyed, printed or brightened substrate may be damp or may be dried before aftertreatment. In a preferred aftertreatment process, the dyed, printed or brightened substrate is added at room temperature to a bath containing the required amount of compound (A) and 5 to 10 g/l of electrolyte, and adjusted with sodium carbonate to pH 10–11. Within 10 minutes the bath is raised to 60° C. and the substrate is treated at this temperature for 20 minutes. Finally, the aftertreated substrate is rinsed, optionally neutralised, and dried.

Dyeings and printings aftertreated according to the invention give better wet fastness properties than untreated dyeings.

The following Examples in which parts and percentages are by weight unless otherwise stated, and temperatures are in °C., illustrate the invention. Percentage figures for components of a dyebath or treatment bath are based on the dry weight of substrate.

PREPARATION OF AFTERTREATMENT AGENTS

(a1)

Diethylenetriamine (103 parts) is mixed with dicyandiamide (84 parts) and the mixture is heated to a temperature of 110° whilst being stirred continuously. At 110°, the reaction becomes exothermic and ammonia is given off. The mixture is then heated slowly over a period of 6 hours to a temperature of 160° until ammonia ceases to be liberated. The total amount of ammonia given off is approximately 34 parts. The reaction product is poured out of the reaction vessel whilst fluid and is allowed to solidify to a powder.

69.3 Parts of the powder are added slowly to 81 parts of water at a temperature of 35° whilst stirring, and then 53.4 parts of 44.6 percent (wt) sulphuric acid are added together with 45 parts of ice so that the temperature does not rise above 48° to 50°. The sulphate addition salt is formed as an aqueous solution, and is converted into a solid powder by spray drying.

(a2)

The product of Example 1 of U.S. Pat. No. 4,439,203.

(a3)

(i) 25.6 Parts 3-dimethylamino-1-propylamine are dissolved in 125 ml water and treated at 0°–5° over 30 minutes with 31.6 parts dimethyl sulphate. The reaction mixture is stirred for one hour at 0°–5° and finally brought to room temperature. The product is added dropwise over 1 hour at 0°–5° to a dispersion obtained by dissolving 46.3 parts cyanuric chloride in 135 parts by volume acetone and stirring the solution into 150 parts ice water. During addition the pH is held between 7 and 8 by addition of aqueous sodium hydroxide solution. After stirring for 15 min, the solution is warmed to room temperature. The product has the formula

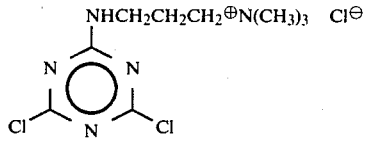

(ii) 86.1 Parts diethylene triamine and 70.3 parts DCDA are heated together to 110°. Ammonia is evolved and an exothermic reaction sets in, the temperature rising to 160°. The product is kept at 160° for 6 hours, then cooled to 90° and treated with 344 parts water. The solution is cooled to room temperature and adjusted to pH 7–7.5 with 52 parts of 96% sulphuric acid.

(iii) To the stirred solution produced under (i) above is added dropwise at room temperature the polymer solution (ii), keeping the pH between 7 and 8 by addition of aqueous caustic soda. The reaction mixture is stirred for 60 minutes and then filtered to give a milky liquid product which is miscible with water in all proportions and can be used directly for pretreatment or aftertreatment of textile materials before or after dyeing. The product has a specific viscosity at 26° of 0.0625 $cm^3/g$.

(a4)

145 Parts N,N-bis-(3-aminopropyl)-methylamine are dissolved in 600 parts water and treated over 30 minutes with 205 parts epichlorohydrin, with stirring and external cooling to hold the temperature at approximately 40°. Stirring at 40° is continued until the viscosity of the solution noticeably increases (after approx. 40–60 minutes).

The mixture is then cooled to room temperature and adjusted to pH 4 with approximately 160 parts 30% hydrochloric acid, with cooling. (The solution is diluted to 1% concentration for pH measurement). A clear, light yellow, viscous solution is obtained, containing approximately 35% solids, and having a specific viscosity of 0.758 $cm^3/g$ in water at 16°.

This aqueous solution may be used directly as an aftertreatment agent.

APPLICATION EXAMPLES

Example 1

A 100% cotton woven fabric is dyed in conventional manner with 2% of the dyestuff of Example 1 of British Published Application No. 2,111,538 A. The dyed substrate is then aftertreated, without an intermediate drying step, for 20 minutes at 60° at a liquor to goods ratio of 20:1 in an aqueous bath containing 2% of the polymeric compound (a1) and 5 g/l sodium carbonate, giving a pH of 11.0. Finally the substrate is rinsed with cold water and dried.

The treated dyeing has good wash fastness properties and is resistant to washing at the boil.

EXAMPLE 2

A cotton woven fabric is dyed in conventional manner with 3% of the copper complex dyestuff of Example 1 of British Application No. 2,122,634 A.

The dyed cotton is treated as described in Example 1, giving a fixed dyeing with good wet fastness properties, which withstands repeated washing operations.

Product (a1) may be replaced in Examples 1 and 2 by products (a2), (a3) or (a4) with similar good results.

What is claimed is:

1. A process for the dyeing or printing of hydroxy group- or nitrogen-containing textile fibres comprising the steps of (a) dyeing or printing the fibres with one or more direct dyestuffs which give a degree of exhaustion of 70 to 100% when dyed on cotton at the boil at 1/1 standard depth and which contain in their molecules at least one 5- or 6-membered heterocyclic aromatic ring substituted by 1 to 3 halogen atoms, and subsequently (b) treating the dyed or printed fibres at a pH of from 8 to 12 with a polymeric, polybasic amino compound (A) selected from the group consisting of (A1) the reaction product of an amine of formula III $$R—NH—R \qquad \text{III}$$

or a polyalkylene polyamine of formula IV $$RRN(Z—X)_nZ—NRR \qquad \text{IV}$$

in which each

R, independently, in hydrogen or a $C_{1-10}$alkyl group unsubstituted or monosubstituted with hydroxy, $C_{1-4}$alkoxy or cyano, n is a number from 0 to 100, Z, or each Z, independently, when n>0, is $C_{2-4}$alkylene or hydroxyalkylene and X, or each X, independently, when n>1, is —O—, —S— or —NR— where R is as defined above, provided that the amine of formula IV contains at least one reactive —NH— or —$NH_2$ group, with cyanamide, dicyandiamide, guanidine or bisguanidine or with co-reagents comprising at least 50 mole % cyanamide dicyandiamide, guanidine or bisguanidine and up to 50 mole % of a dicarboxylic acid or mono- or di-ester thereof;

(A2) the reaction product of compound (A1) with an epihalohydrin or a precursor thereof;

(A3) the reaction product of compound (A1) with an organic compound (B) containing at least two groups capable of being split off as anions on reaction with (A1);

and (A4) the reaction product of an epihalohydrin or a precursor thereof with a polyalkylene polyamine.

2. A process according to claim 1 in which the textile fibres are cotton, or cotton blended with other fibres.

3. A process according to claim 1 in which the fibres are dyed with a direct dye containing one or two mono- or di-chlorotriazinyl groups per molecule.

4. A process according to claim 3 in which the direct dye is of formula I or II

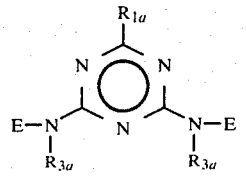

I

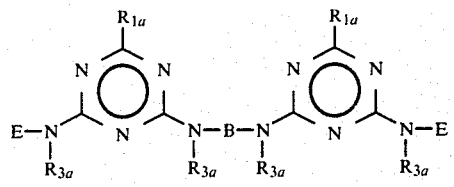

II in which each $R_{3a}$ independently is hydrogen; $(C_{1-4})$alkyl; or $(C_{1-4})$alkyl substituted by one —OH, —CN or phenyl group;

$R_{1a}$ is Cl or F, the E's are identical or different chromophoric groups and B is a direct bond or a divalent aliphatic, aromatic, cycloaliphatic or heterocyclic bridging group, or forms a heterocyclic bridging group together with the two

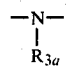

groups to which it is joined.

5. A process according to claim 4 in which, in the dye of formula II, B is of formula

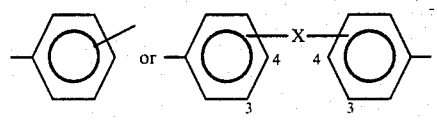

in which X can be bound in the 4,4-, 3,4- or 3,3-positions and represents a direct bond or a bridging group such as is conventional in the chemistry of direct dyestuffs, or may form a piperazine ring together with the two

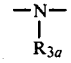

groups to which it is bound.

6. A process according to claim 1 in which the polymeric, polybasic amino compound (A) is compound (A1).

7. A process according to claim 6 in which compound (A1) is the reaction product of dicyandiamide with diethylenetriamine or triethylenetetramine.

8. A process according to claim 1 in which the polymeric polybasic amino compound (A) is a compound (A2).

9. A process according to claim 1 in which the polymeric polybasic amino compound (A) is a compound (A3).

10. A process according to claim 9 in which (A3) is the reaction product of (A1) with a compound (B) of formula V, VI or VII $HN(CH_2CH_2Cl)_2$ V $BrCH_2CH_2Br$ VI

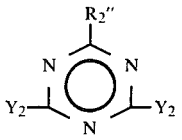

VII in which both $Y_2$'s are identical and are Cl or Br $R_2''$ is Cl or —NH—$C_3H_6$—$N^{\oplus}(CH_3)_3$ $A^{\ominus}$ where $A^{\ominus}$ is $Cl^{\ominus}$ or $CH_3SO_4^{\ominus}$.

11. A process according to claim 1 in which the polymeric, polybasic amino compound (A) is a compound (A4).

12. A process according to claim 11 in which (A4) is the product of reacting 1.5 to 2.5 moles of epichlorohydrin with 1 mole of a polyalkylene polyamine of formula VIII

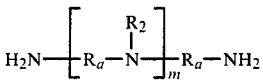

VIII in which m is a number from 1 to 5;

each $R_a$ independently, is a $C_{2-4}$alkylene group and each $R_2$ independently is phenyl, $C_{1-4}$alkyl or $C_{1-4}$alkyl substituted by a —OH, $C_{1-4}$alkoxy, halogen or phenyl group.

13. A process according to claim 12 in which compound (A4) is the product of reacting 1.8–2.3 mole epichlorohydrin with 1 mole of N,N-bis-(3-aminopropyl)methylamine.

14. A process according to claim 1 in which, in step (b), compound (A) is applied by an exhaust process.

15. A process according to claim 1 in which step (b) is carried out at a pH from 10 to 11.

16. A process according to claim 1 wherein the dyestuff or dyestuffs contain at least two sulphonic acid or sulphonamide groups, have a molecular weight above 1000 and are in the form of 1:1 or 1:2 metal complexes.

17. A process according to claim 16 wherein the dyestuff or dyestuffs contain one or two mono- or dichlorotriazinyl groups per molecule.

18. A process according to claim 1 wherein, in formula IV, each R is hydrogen, n is 0 to 4, X is —NH— or —$NCH_3$—, and Z, or each Z independently when $n>0$, is $C_{2-4}$alkylene.

19. A process according to claim 18 wherein compound (A) is selected from the group consisting of (A1) the reaction product of an amine of formula IV with cyanamide, dicyandiamide, guanidine or bisguanidine;

(A2) the reaction product of (A1) with epichlorohydrin, (A3) the reaction product of (A1) with a compound (B) of formula V, VI or VII $HN(CH_2CH_2Cl)_2$ V $BrCH_2CH_2Br$ VI

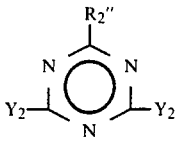

VII in which both $Y_2$'s are identical and are Cl or Br $R_2''$ is Cl or —NH—$C_3H_6$—$N^{\oplus}(CH_3)_3$ $A^{\ominus}$ where $A^{\ominus}$ is $Cl^{\ominus}$ or $CH_3SO_4^{\ominus}$; and (A4) the product of reacting 1.5 to 2.5 mols of epichlorohydrin with 1 mole of a polyalkylene polyamine of formula VIII

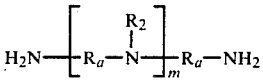

VIII in which m is a number from 1 to 5;

each $R_a$, independently, is a $C_{2-4}$alkylene group and each $R_2$, independently, is phenyl, $C_{1-4}$alkyl or $C_{1-4}$alkyl substituted by a —OH, $C_{1-4}$alkoxy, halogen or phenyl group.

20. A process according to claim 19 in which compound (A1) is the reaction product of dicyandiamide with diethylenetriamine or triethylenetetramine.

21. A process according to claim 4 wherein the polybasic amino compound (A) is a compound (A1).

22. A process according to claim 21 in which compound (A1) is applied by an exhaust process from a bath having a liquor to goods ratio from 2:1 to 50:1.

23. A process according to claim 22 in which step (b) is carried out a pH from 10 to 11.

24. A process according to claim 5 wherein, in step (b) the polybasic amino compound (A) is the reaction product of dicyandiamide with diethylenetriamine or triethylenetetramine.

25. A process according to claim 24 wherein the polybasic amino compound (A) is the product of reacting dicyandiamide with diethylenetriamine or triethylenetetramine in a mol ratio of 2:1 to 1:2.

26. A process according to claim 25 in which compound (A) is applied by an exhaust process from a bath having a liquor to goods ratio from 2:1 to 50:1 and a pH from 10 to 11.

27. A process according to claim 1 wherein the dyestuff or dyestuffs contain at least two sulphonic acid or sulphonamide groups and one or two mono- or dichlorotriazinyl groups per molecule, have a molecular weight above 1000 and are in the form of 1:1 or 1:2 metal complexes;

(A1) is the reaction product of an amine of formula III or IV with 0.1 to 1 mole, per mole of reactive —NH— or —$NH_2$ groups in the amine or polyamine, of cyanamide, dicyandiamide, guanidine or bisguanidine or of co-reagents comprising at least 80 mole % cyanamide, dicyandiamide, guanidine or bisguanidine or up to 20 mole % dicarboxylic acid or mono- or di-ester thereof;

(A2) is the product of reacting (A) with epichlorohydrin in a mol ratio of 1:0.3–2

(A3) is the product of reacting (A1) with a compound (B) of formula V, VI or VII $HN(CH_2CH_2Cl)_2$ V $BrCH_2CH_2Br$ VI

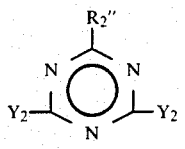

VII in which both $Y_2$'s are identical and are Cl or Br and $R_2''$ is Cl or $—NH—C_3H_6—N^{\oplus}(CH_3)_3\ A^{\ominus}$ where $A^{\ominus}$ is $Cl^{\ominus}$ or $CH_3SO_4^{\ominus}$ in a ratio of 0.05 to 1.5 moles (B) per equivalent of (A1);

and (A4) is the product of reacting 1.5 to 2.5 mols of epichlorohydrin with 1 mole of a polyalkylene polyamine of formula VIII

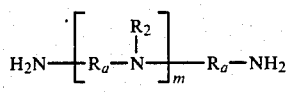

VIII in which m is a number from 1 to 5;

each $R_a$, independently, is a $C_{2-4}$alkylene group and each $R_2$, independently, is phenyl, $C_{1-4}$alkyl or $C_{1-4}$alkyl substituted by a —OH, $C_{1-4}$alkoxy, halogen or phenyl group.

28. A process according to claim 8 wherein the compound (A2) is the reaction product of compound (A1) with epichlorohydrin and is in the form of a stable aqueous dispersion acidified to pH 2–5.

29. A process according to claim 28 wherein compound (A1) is a reaction product of a polyalkylene polyamine of formula IV, in which each R is hydrogen, n is 0 to 4, X is —NH— or $—NCH_3—$ and Z, or each Z independently when $n>4$, is $C_{2-4}$alkylene, with 0.1 to 1 mole per mole of reactive —NH— or $—NH_2—$ groups in the polyamine, of cyanamide, dicyandiamide, guanidine or bisguanidine and up to 20 mole % of a dicarboxylic acid or mono- or di-ester thereof.

30. A process according to claim 29 wherein the compound (A2) is the product of reacting (A1) with epichlorohydrin in a mole ratio of 1:0.3–2.

31. A process according to claim 30 wherein compound (A2) is in the form of a stable aqueous dispersion acidified to pH 4–4.5.

* * * * *